US009551224B2

(12) United States Patent
Onishi et al.

(10) Patent No.: US 9,551,224 B2
(45) Date of Patent: Jan. 24, 2017

(54) TURBINE AND METHOD FOR MANUFACTURING TURBINE

(75) Inventors: Tomoyuki Onishi, Tokyo (JP); Yuichiro Waki, Tokyo (JP); Shoki Yamashita, Tokyo (JP); Takaaki Matsuo, Tokyo (JP); Asaharu Matsuo, Kobe (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 711 days.

(21) Appl. No.: 13/818,016

(22) PCT Filed: Oct. 28, 2011

(86) PCT No.: PCT/JP2011/074918

§ 371 (c)(1),
(2), (4) Date: Feb. 20, 2013

(87) PCT Pub. No.: WO2012/057309

PCT Pub. Date: May 3, 2012

(65) Prior Publication Data

US 2013/0149125 A1 Jun. 13, 2013

(30) Foreign Application Priority Data

Oct. 29, 2010 (JP) ..... 2010-244290

(51) Int. Cl.
*F04D 29/54* (2006.01)
*F01D 5/12* (2006.01)
(Continued)

(52) U.S. Cl.
CPC ..... *F01D 5/12* (2013.01); *F01D 5/3069* (2013.01); *F01D 9/042* (2013.01); *F01D 11/001* (2013.01); *F01D 11/003* (2013.01)

(58) Field of Classification Search
CPC ..... F01D 5/12; F01D 5/22; F01D 5/225; F01D 5/3069; F01D 9/042; F01D 11/001; F01D 11/005; F01D 11/006
See application file for complete search history.

(56) References Cited

U.S. PATENT DOCUMENTS 3,746,462 A 7/1973 Fukuda
5,593,273 A 1/1997 Brinkman
(Continued)

FOREIGN PATENT DOCUMENTS

CN 1277651 A 12/2000
CN 1894485 A 1/2007
(Continued)

OTHER PUBLICATIONS

International Search Report of PCT/JP2011/074918, date of mailing Nov. 29, 2011; with English translation.
(Continued)

*Primary Examiner* — Thomas Denion
*Assistant Examiner* — Matthew T Largi
(74) *Attorney, Agent, or Firm* — Westerman, Hattori, Daniels & Adrian, LLP

(57) ABSTRACT

The turbine includes: a shaft body supported rotatably; a plurality of turbine blade members; a casing covering the shaft body and the turbine blade row; an outer ring member that is provided on an inner periphery of the casing and includes an inner peripheral portion in which a cross-section having a uneven shape is continuous in a circumferential direction; a plurality of turbine vane members that each has a shroud fitted into the inner peripheral portion of the outer ring member and a turbine vane main body extending from the shroud to a radially inward side; and a plate member that connects at least some of the plurality of turbine vane members and covers one side of the shrouds in the axial
(Continued)

direction, thereby sealing a shroud gap formed between the shrouds adjacent to each other in the circumferential direction.

11 Claims, 13 Drawing Sheets

(51) Int. Cl.

| | |
|---|---|
| ***F01D 9/04*** | (2006.01) |
| ***F01D 11/00*** | (2006.01) |
| ***F01D 5/30*** | (2006.01) |

(56) References Cited

U.S. PATENT DOCUMENTS

| | | | | |
|---|---|---|---|---|
| 5,984,633 | A | 11/1999 | Bachinger et al. | |
| 2005/0111969 | A1* | 5/2005 | Arness | F01D 9/042 415/189 |
| 2005/0232764 | A1 | 10/2005 | Chiu et al. | |
| 2006/0000283 | A1* | 1/2006 | Twerdochlib | G01H 1/003 73/593 |
| 2010/0061845 | A1 | 3/2010 | Turzing | |

FOREIGN PATENT DOCUMENTS

| | | | | |
|---|---|---|---|---|
| CN | 101220757 | A | | 7/2008 |
| CN | 101672202 | A | | 3/2010 |
| EP | 1 803 898 | A2 | | 7/2007 |
| GB | 2 422 641 | A | | 8/2006 |
| JP | 61-079805 | A | | 4/1986 |
| JP | 09-013905 | A | | 1/1997 |
| JP | 11-506814 | A | | 6/1999 |
| JP | 2003-525382 | A | | 8/2003 |
| JP | 2005-146896 | A | | 6/2005 |
| JP | 2005146896 | A | * | 6/2005 |
| JP | 2005-307892 | A | | 11/2005 |
| JP | 2005-307970 | A | | 11/2005 |
| JP | 2005307892 | A | * | 11/2005 |
| JP | 2007-120321 | A | | 5/2007 |
| JP | 2007-512474 | A | | 5/2007 |
| JP | 2007120321 | A | * | 5/2007 |
| JP | 2010-508458 | A | | 3/2010 |
| JP | 2010-144707 | A | | 7/2010 |

OTHER PUBLICATIONS

Written Opinion of PCT/JP2011/074918, date of mailing Nov. 29, 2011; with English translation.

Extended European Search Report dated Feb. 27, 2014, issued in corresponding European application No. 11836442.1 (5 pages).

Chinese Office Action dated Jun. 3, 2014, issued in Chinese Patent Application No. 201180040377.4, w/English translation (10 pages).

Office Action dated Jul. 1, 2016, issued in counterpart Chinese Patent Application No. 201510751092.1, with English translation of Search Report only. (7 pages).

Decision to Grant a European Patent dated Nov. 24, 2016, issued in counterpart European Patent Application No. 11836442.1. (2 pages).

* cited by examiner

TURBINE AND METHOD FOR MANUFACTURING TURBINE

TECHNICAL FIELD

The present invention relates to a turbine and a method for manufacturing a turbine.

Priority is claimed on Japanese Patent Application No. 2010-244290 filed on Oct. 29, 2010, the contents of which are incorporated herein by reference.

BACKGROUND ART

In the related art, there is known a steam turbine which includes a casing, a shaft body rotatably provided in the inside of the casing, a plurality of turbine vanes fixedly disposed at an inner peripheral portion of the casing, and a plurality of turbine blades radially provided at the shaft body in the downstream sides of the plurality of turbine vanes.

In PTL 1 below, a turbine vane structure ring is constituted by using a turbine vane member having a turbine vane element, an outer shroud element, and an inner shroud element, an outer ring in which a fitting groove is formed in the inner periphery and which is supported on a casing, and an inner ring in which a fitting groove is formed in the outer periphery and which surrounds a rotor.

Specifically, the turbine vane element is annularly retained by inserting and fitting the outer shroud element of each turbine vane member into the fitting groove of the outer ring and also inserting and fitting the inner shroud element into the fitting groove of the inner ring.

CITATION LIST

Patent Literature

[PTL 1] Published Japanese Translation No. 2003-525382 of the PCT International Publication

SUMMARY OF INVENTION

Problem to be Solved by the Invention

However, in a turbine of the related art, since a gap is formed between outer shrouds adjacent to each other in a circumferential direction, there is a possibility that steam may leak from the gap to the turbine blade side, thereby causing loss.

The present invention has been made in consideration of such circumstances and has an object of improving turbine efficiency.

Solution to Problem

According to a first aspect of the invention, there is provided a turbine including: a shaft body supported rotatably; a plurality of turbine blade members that is provided on an outer periphery of the shaft body and constitutes a turbine blade row in a circumferential direction of the shaft body; a casing covering the shaft body and the turbine blade row; an outer ring that is provided on an inner periphery of the casing and includes an inner peripheral portion in which a cross-section having an uneven shape is continuous in a circumferential direction; a plurality of turbine vane members that each has a shroud fitted into the inner peripheral portion of the outer ring and a turbine vane main body extending from the shroud to a radially inward side and that is provided in the circumferential direction and constitutes a turbine vane row in which the shrouds adjacent to each other are aligned in the circumferential direction; and a plate member that connects at least some of the plurality of turbine vane members and covers one side of the shrouds in the axial direction, thereby sealing a shroud gap formed between the shrouds adjacent to each other in the circumferential direction.

According to this configuration, the plate member connects the plurality of turbine vane members and also covers the shrouds of the turbine vane members from one side in the axial direction, thereby sealing the shroud gap formed between the shrouds. Therefore, working fluid that heads for the shroud gap from one side in the axial direction collides with the plate member, and thus inflow of the working fluid to the shroud gap is blocked. In this manner, the working fluid collided with the plate member flows to the turbine vane main body side, thereby joining a main flow of the working fluid. Therefore, since the flow rate of the main flow can be increased, turbine efficiency can be improved.

Further, since the plate member blocks inflow of the working fluid to the shroud gap, there is almost no working fluid flowing out from the shroud gap to the main flow side in the turbine vane row. This way, since it becomes difficult for disturbance of the main flow to occur in the turbine vane row, and thus the flow of the main flow flowing out from the turbine vane row becomes a designed flow, the turbine efficiency can be improved.

Further, a plurality of plate members may be provided continuously in the circumferential direction.

According to this configuration, since the plurality of plate members is provided continuously in the circumferential direction, it is possible to seal the shroud gaps that are formed over the circumferential direction.

Further, the plate member may be provided over the circumference of the entirety of the plurality of shrouds.

According to this configuration, it is possible to seal all the shroud gaps that are formed in a plurality over the circumferential direction.

Further, the inner peripheral portion of the inner ring may be formed in the form of a groove extending in the circumferential direction and the plate member may seal at least part of the portion exposed from the inner peripheral portion of the inner ring to the radially inward side, of the shroud gap.

According to this configuration, since the plate member seals at least a portion of the portion exposed to the radially inward side, of the shroud gap, a portion that is exposed to the main flow of the working fluid is sealed. In this way, the working fluid flowing in the shroud gap can be effectively reduced.

Further, the plate member may seal the entire shroud gap.

According to this configuration, since the plate member seals the entire shroud gap, a leakage flow flowing into the shroud gap can be further reduced.

According to a second aspect of the invention, a method is provided for manufacturing a turbine that includes a shaft body supported rotatably, a plurality of turbine blade members that is provided on an outer periphery of the shaft body and constitutes a turbine blade row in a circumferential direction of the shaft body, a casing covering the shaft body and the turbine blade row, an outer ring that is provided on an inner periphery of the casing and includes an inner peripheral portion in which a cross-section having an uneven shape is continuous in a circumferential direction, and a plurality of turbine vane members that each has a shroud fitted into the inner peripheral portion of the outer ring and a turbine vane main body extending from the shroud to a radially inward side and that is provided in the circumferential direction and constitutes a turbine vane row in which the shrouds adjacent to each other are aligned in the circumferential direction, the method includes: a preparing process of preparing a plurality of turbine vane members, a plate member, and a plurality of outer ring members constituting the outer ring, in advance; a coupling process of coupling and integrating the shrouds of the plurality of turbine vane members belonging to one of a plurality of turbine vane member groups made by grouping the plurality of turbine vane members, by the plate member; an intermediate unit manufacturing process of manufacturing an intermediate unit by fitting the shrouds of the plurality of turbine vane members coupled and integrated by the plate member into an inner peripheral portion of the outer ring member; and a connection process of connecting the intermediate unit to a unit in which the plurality of turbine vane members belonging to the other turbine vane member group is fitted into the outer ring member.

According to this method, it is possible to easily obtain a configuration in which the turbine efficiency can be improved.

Further, since the method includes the coupling process of coupling and integrating the shrouds of the plurality of turbine vane members by the plate member and the intermediate unit manufacturing process of manufacturing an intermediate unit by fitting the shrouds of the plurality of turbine vane members coupled and integrated, into the inner peripheral portion of the outer ring member, the plurality of turbine vane members integrated is fitted together into the inner peripheral portion of the outer ring. That is, in a method for manufacturing a turbine in the related art, when incorporating turbine vane members into an outer ring member, since the outer shrouds have to be individually fitted into an inner peripheral portion of the outer ring member, labor is required for assembly. However, according to the above-described configuration, since the labor of fitting the plurality of turbine vane members one by one into the inner peripheral portion of the outer ring member is omitted, assembly can be easily performed.

Further, the unit may be constituted as the intermediate unit.

According to this configuration, since at the time of configuration of the unit, the labor of fitting the plurality of turbine vane members one by one into the inner peripheral portion of the outer ring member is omitted, assembly can be more easily performed.

Advantageous Effects of Invention

According to the turbine related to the aspects of the present invention, the turbine efficiency can be improved.

Further, according to the method for manufacturing a turbine related to the aspect of the present invention, assemblability can be improved.

DESCRIPTION OF EMBODIMENTS

Figure 1:
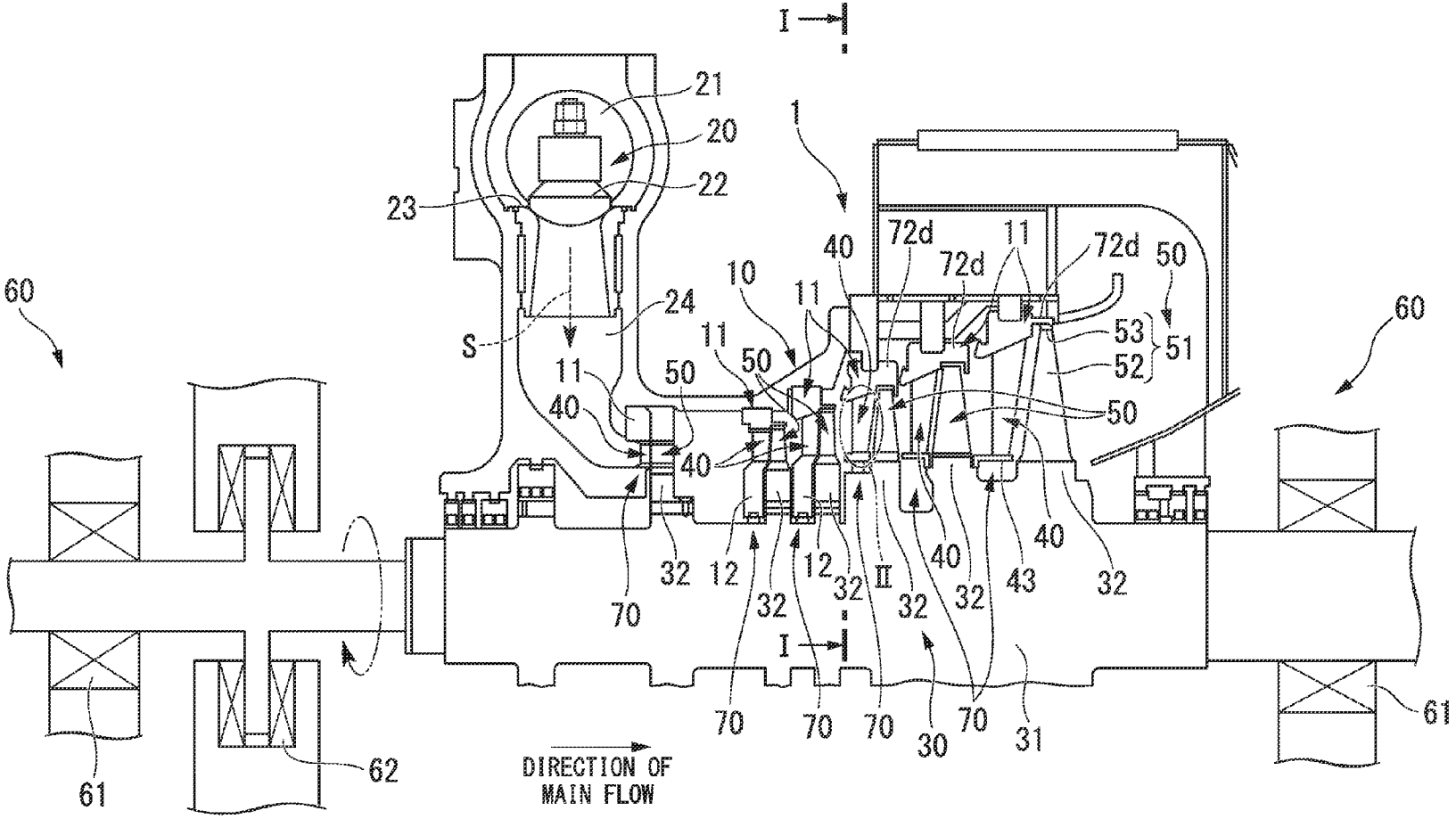
FIG. 1 is a cross-sectional view showing the schematic configuration of a steam turbine related to a first embodiment of the present invention.

Hereinafter, embodiments of the present invention will be described in detail referring to the drawings.

First Embodiment

FIG. 1 is a cross-sectional view showing the schematic configuration of a steam turbine (a turbine) 1 related to a first embodiment of the present invention.

The steam turbine 1 includes a casing 10, an adjusting valve 20 that adjusts the amount and the pressure of steam S flowing into the casing 10, a shaft body 30 that is rotatably provided inside the casing 10 and transmits power to a machine (not shown) such as an electric generator, a plurality of turbine vane rows 40 disposed on the inner periphery of the casing 10, a plurality of turbine blade rows 50 arranged on the outer periphery of the shaft body 30, and a bearing unit 60 that supports the shaft body 30 so as to be able to rotate around an axis.

The casing 10 isolates an internal space from the outside and the internal space is hermetically sealed. The casing 10 surrounds the shaft body 30 and the turbine blade row 50.

The adjusting valve 20 is mounted pieces in the inside of the casing 10. The adjusting valve 20 includes an adjusting valve chamber 21 into which the steam S flows from a boiler (not shown), a valve body 22 that can be displaced, and a valve seat 23 in which the valve body 22 can be seated thereon and separated therefrom. If the valve body 22 is separated from the valve seat 23, a steam flow path is opened, and thus the steam S flows into the internal space of the casing 10 through a steam chamber 24.

The shaft body 30 includes a shaft main body 31 and a plurality of disks 32 extending in a radial direction from the outer periphery of the shaft main body 31. The shaft body 30 transmits rotational energy to a machine (not shown) such as an electric generator.

Figure 2:
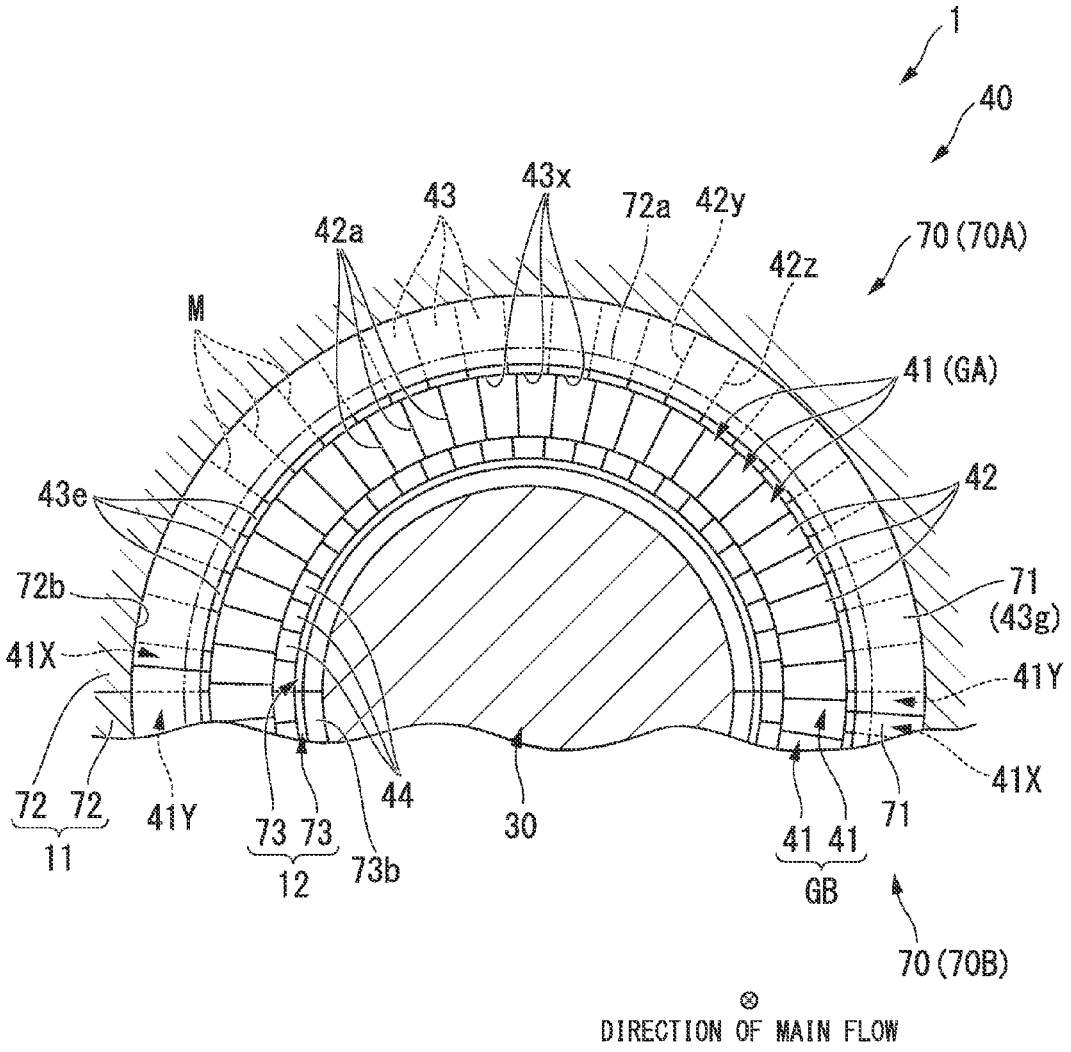
FIG. 2 is a cross-sectional view taken along line I-I in FIG. 1.

The turbine vane row 40 includes a large number of turbine vane members 41 radially disposed so as to surround the shaft body 30 (refer to FIG. 2). The turbine vane rows 40 is connected by an outer ring 11 at the radially outward side and also connected by an inner ring 12 at the radially inward side (described later).

The turbine vane rows 40 are formed in a plurality of stages at intervals in a direction of a rotation axis. The turbine vane row 40 guides the steam S to the turbine blade row 50 adjacent to the downstream side.

The turbine blade row 50 includes a large number of turbine blade members 51 radially disposed so as to surround the shaft body 30. Each turbine blade member 51 includes a turbine blade main body 52 that converts the velocity energy that main flow of the steam S has, into rotational energy and a tip shroud 53 formed at a tip portion in the radial direction of the turbine blade main body 52. The turbine blade member 51 is solidly mounted on the outer periphery of each disk 32 of the shaft body 30 at the radially inward side thereof.

The turbine blade row 50 is provided on the downstream side of each turbine vane row 40 and a set of turbine blade row 50 and turbine vane row 40 configures one stage. That is, the steam turbine 1 is configured such that the main flow of the steam S alternately flows through the turbine vane row 40 and the turbine blade row 50. In the following description, the direction of the rotation axis of the shaft body 30 is referred to as an "axial direction", the upstream side of the main flow in the axial direction is referred to as a "one side in the axial direction", and the downstream side of the main flow in the axial direction is referred to as the "other side in the axial direction".

The bearing unit 60 includes a journal bearing apparatus 61 and a thrust bearing apparatus 62. The bearing unit 60 rotatably supports the shaft body 30.

In the steam turbine 1 described above, a turbine vane unit 70 is adopted as a mounting structure of the turbine vane row 40.

Figure 3:
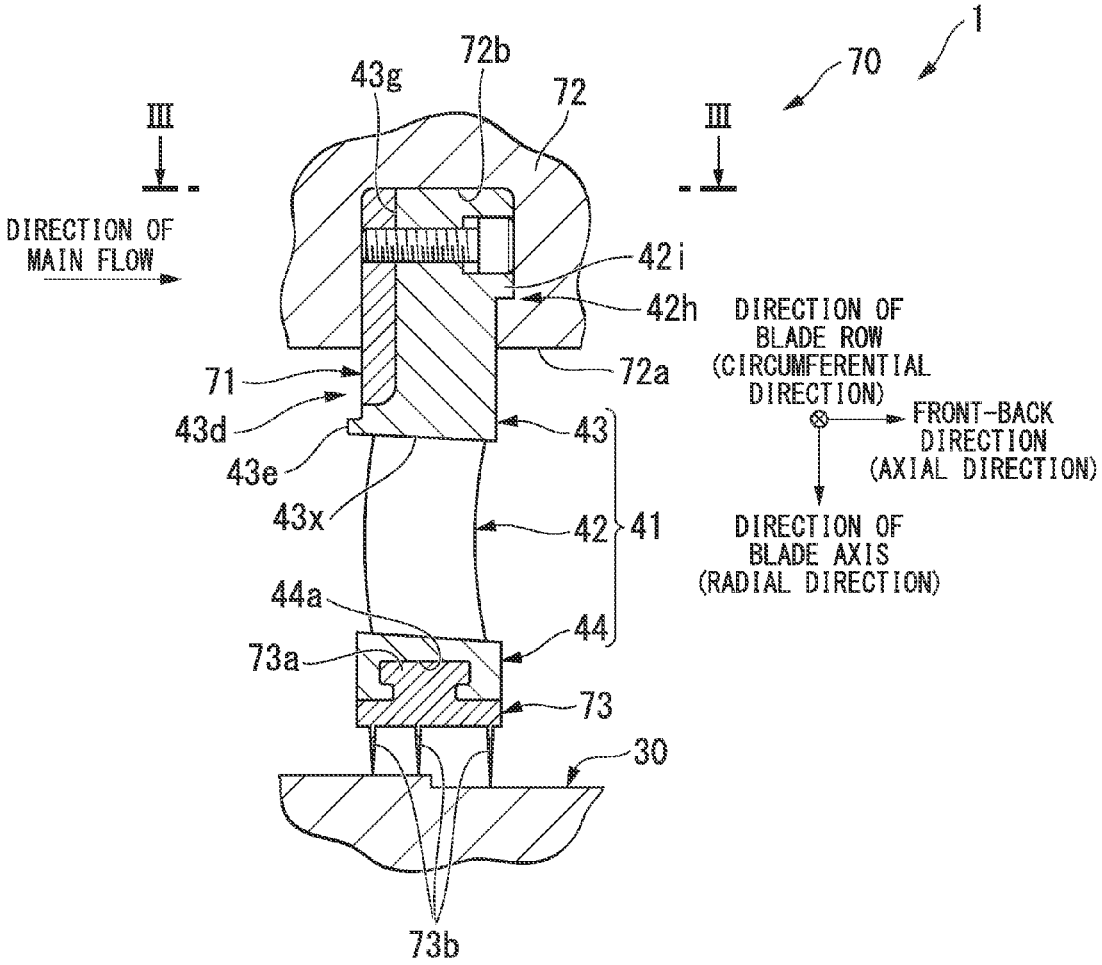
FIG. 3 is an enlarged cross-sectional view of a main section II in FIG. 1.
Figure 4:
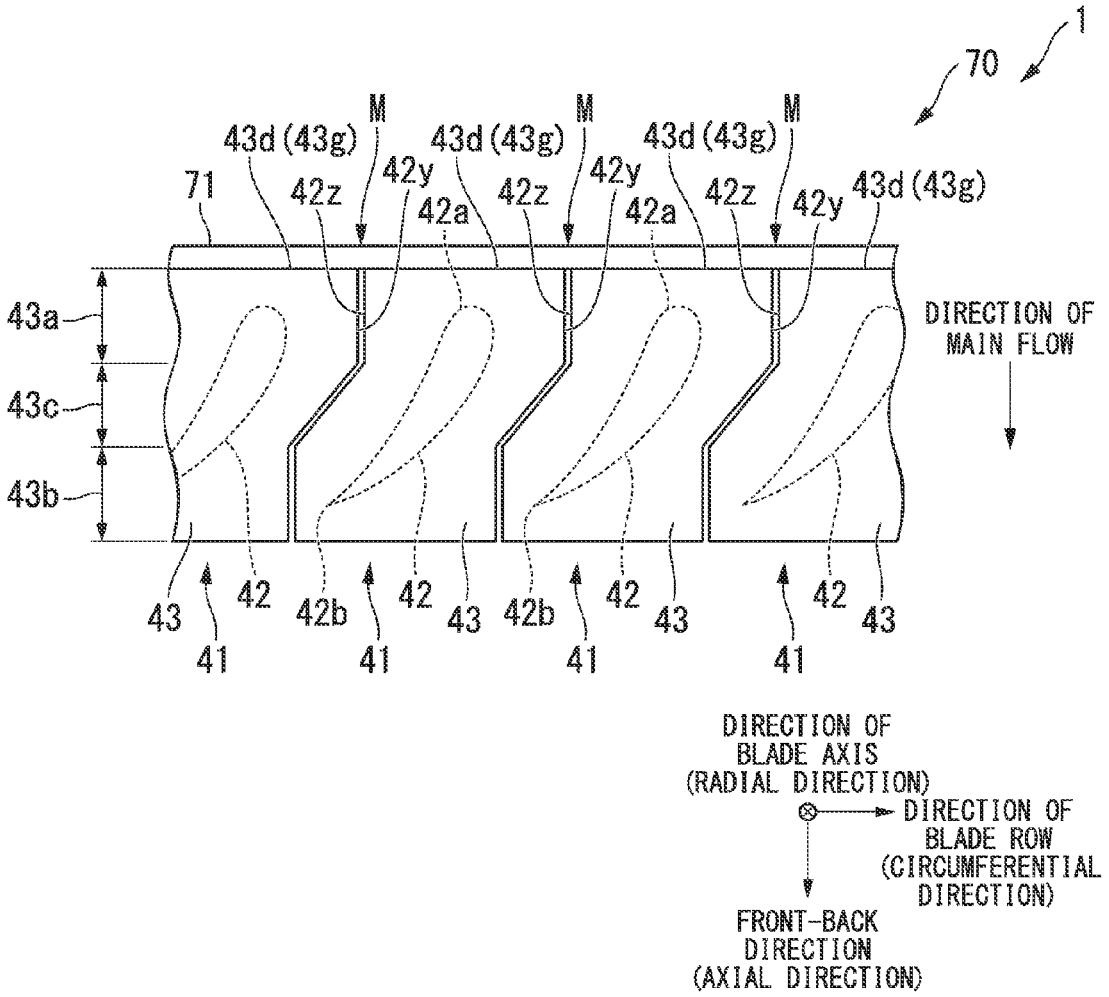
FIG. 4 is a view in the direction of an arrow of line III-III in FIG. 3.
Figure 5:
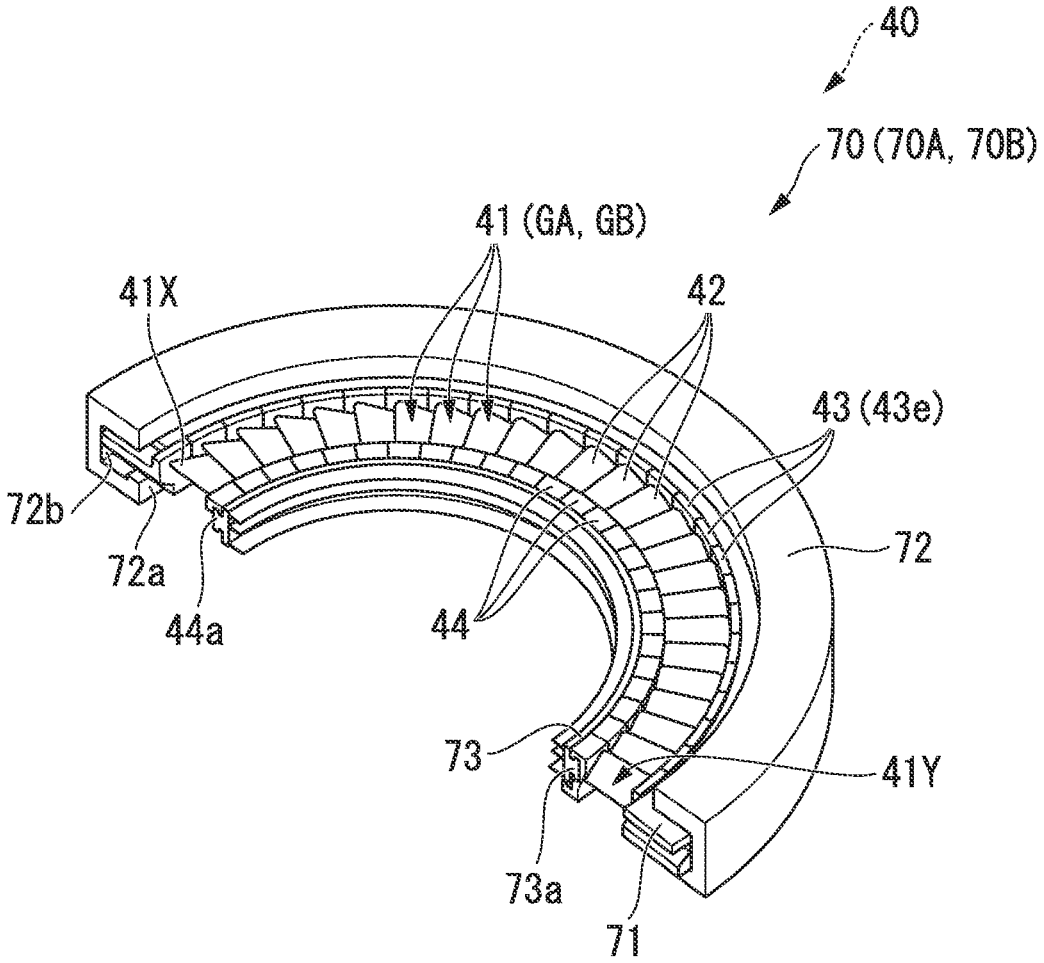
FIG. 5 is a schematic configuration perspective view of a turbine vane unit related to the first embodiment of the present invention.

FIG. 2 is a cross-sectional view along line I-I in FIG. 1, FIG. 3 is an enlarged cross-sectional view of a main section II in FIG. 1, FIG. 4 is a view in the direction of an arrow of line III-III in FIG. 3, and FIG. 5 is a schematic configuration perspective view of the turbine vane unit 70 (70A or 70B).

A pair of turbine vane units 70 (70A and 70B) is disposed for each turbine vane row 40, as shown in FIG. 2, and respectively retains turbine vane member groups GA and GB each composed of half the turbine vane members 41 of all the turbine vane members 41 constituting the turbine vane row 40.

A plate member 71, an outer ring member 72, and an inner ring member 73 are assembled to each of the turbine vane member groups G (GA and GB), whereby the pair of turbine vane units 70 (70A and 70B) is constituted.

The turbine vane member 41 includes a turbine vane main body 42 in which a blade cross-section (refer to FIG. 4) is reduced toward a tip from a base end in the direction of a blade axis, an outer shroud (a shroud) 43 connected to the base end of the turbine vane main body 42, and an inner shroud 44 connected to the tip of the turbine vane main body 42, as shown in FIGS. 2 and 3.

In the turbine vane member 41, the direction of the blade axis of the turbine vane main body 42 is directed in the radial direction of the steam turbine 1 such that the tip side is located on the shaft body 30 side, as shown in FIG. 3. Further, in the turbine vane member 41, the front-back direction of the turbine vane main body 42 is directed in the axial direction, as shown in FIG. 4.

The outer shroud 43 is formed in the form of a block. The outer shroud 43 is formed in the form of an arc band in which the turbine vane main body 42 side thereof is concave when viewed in the front-back direction of the turbine vane main body 42 (when viewing a trailing edge 42*b* side from a leading edge 42*a* side), as shown in FIG. 2, and the turbine vane main body 42 is continuous with an inner peripheral surface 43*x* thereof.

In the outer shroud 43, as shown in FIG. 4, a front portion 43*a* formed on the leading edge 42*a* side of the turbine vane main body 42 and a rear portion 43*b* formed on the trailing edge 42*b* side of the turbine vane main body 42 are connected by an intermediate portion 43*c*.

In the outer shroud 43, as shown in FIG. 4, in each cross-section intersecting the direction of the blade axis (the radial direction), each of the front portion 43*a* and the rear portion 43*b* is formed in a rectangular shape, the rear portion 43*b* is located to be shifted with respect to the front portion 43*a* in a direction toward the trailing edge 42*b* from the leading edge 42*a* of the turbine vane main body 42, and the intermediate portion 43*c* formed in the shape of a parallelogram connects the front portion 43*a* and the rear portion 43*b*.

At a front end 43*d* of the outer shroud 43, as shown in FIG. 3, each of an inner peripheral edge 43*e* formed on the inner peripheral surface 43*x* side and a recess portion 43*g* formed over an area from the inner peripheral edge 43*e* to the outer periphery and also relatively recessed with respect to the inner peripheral edge 43*e* is formed in the form of an arc band when viewed in the front-back direction (refer to FIG. 2).

Further, as shown in FIG. 3, a rear end 42*h* of the outer shroud 43 is formed in a step shape and a protrusion portion 42*i* protruding in the front-back direction at the outer periphery side is formed at a rear end 42*h* of the outer shroud 43.

The external appearance shape of the inner shroud 44 is formed in a form substantially similar to the outer shroud 43. At an inner peripheral portion of the inner shroud 44, as shown in FIG. 3, a fitting groove 44*a* that is recessed to the turbine vane main body 42 side and also extends in the circumferential direction, is formed.

The turbine vane members 41 are arranged in a semi-annular shape in the circumferential direction with the outer shroud 43 and the inner shroud 44 confronting with each other for each turbine vane member group G (GA or GB), as shown in FIG. 2. Then, as shown in FIG. 4, in the outer shrouds 43 adjacent to each other in the circumferential direction, one end face 42*y* on one side closely faces the other end face 42*z* on the other side, thereby forming a shroud gap M in the circumferential direction.

The plate member 71 is formed in the form of an arc band when viewed in the thickness direction, as shown in FIG. 3. The radial dimension and the thickness dimension of the plate member 71 are made to be approximately the same as the radial dimension and the depth dimension of the recess portion 43*g* of the outer shroud 43 of each turbine vane member 41. The plate member 71 is bolted onto the outer shroud 43 of each turbine vane member 41 in a state of being fitted into each recess portion 42*g* of the turbine vane members 41 arranged in a semi-annular shape.

This way, the plate member 71 connects the respective outer shrouds 43, as shown in FIGS. 2 and 4, and also covers the recess portion 43*g* of the outer shroud 43 of each turbine vane member 41, as shown in FIG. 3. The plate member 71 is provided to be shifted by half a pitch in the circumferential direction with respect to the turbine vane members 41 arranged in a semi-annular shape, thereby exposing by half a pitch in the circumferential direction of the outer shroud 43 of the turbine vane member 41 of one end in the circumferential direction (denoted by a sign 41X in FIGS. 2 and 5), and also extends in the circumferential direction by half a pitch from the outer shroud 43 of the turbine vane member 41 of the other end in the circumferential direction (denoted by a sign 41Y in FIGS. 2 and 5).

The outer ring member 72 is formed in the form of a semi-ring, as shown in FIGS. 2 and 5.

As shown in FIG. 3, at an inner peripheral portion 72*a* of the outer ring member 72, a semi-annular groove portion 72*b* extending in the circumferential direction and also having a cross-sectional contour of a uneven shape (more specifically, approximately rectangular shape) is formed. The semi-annular groove portion 72*b* is formed such that the groove depth dimension thereof is smaller than the dimension in the direction of the blade axis of the outer shroud 43. Then, the semi-annular groove portion 72*b* is fitted to the radially outward sides of the turbine vane members 41 arranged in a semi-annular shape and the plate member 71 onto which each turbine vane member 41 is bolted, and exposes the radially inward sides of the turbine vane members 41 and the plate member 71, as shown in FIGS. 2 and 3.

At the outer ring member 72, as shown in FIG. 1, a semi-annular extension portion 72*d* extending toward the other side in the axial direction of the shaft body 30 is formed (not shown in FIG. 5). The semi-annular extension portion 72*d* is matched to the semi-annular extension portion 72*d* of the paired outer ring member 72, thereby forming an annular shape as a whole, and faces the tip shroud 53 of the turbine blade member 51.

The inner ring member 73 is formed in the form of a semi-ring, as shown in FIG. 2. The inner ring member 73 has a protruded portion 73*a* protruding to the radially outward side at an outer peripheral portion and also extending in the circumferential direction, and a plurality of seal fin sections 73*b* (not shown in FIG. 5) extending to the radially inward side at an inner peripheral portion and also extending in the circumferential direction, as shown in FIG. 3.

As shown in FIG. 3, the protruded portion 73*a* is fitted into the fitting groove 44*a* of the inner shroud 44, whereby the inner ring member 73 is supported on the inner shroud 44, and the plurality of seal fin sections 73*b* forms a minute gap with the shaft body 30.

Both end portions in the circumferential direction of one side of the turbine vane units 70A and 70B are connected to both end portions in the circumferential direction of the other side.

More specifically, as shown in FIG. 2, the turbine vane member 41X in one end in the circumferential direction of one of the turbine vane units 70A and 70B is matched to the turbine vane member 41Y in the other end in the circumferential direction of the other side, thereby forming the shroud gaps M in the circumferential direction. Then, as shown in FIG. 2, the outer shroud 43 (the turbine vane member 41X) exposed by half a pitch by the plate member 71 of one of the turbine vane units 70A and 70B is covered by a portion (the turbine vane member 41Y side) extending in the circumferential direction by half a pitch, of the plate member 71 of the other.

In this way, the plate member 71 is disposed over the circumference of the entirety of the outer shrouds 43 of the plurality of turbine vane members 41 constituting the turbine vane row 40.

Subsequently, an assembly method of the turbine vane unit 70 and the steam turbine 1 will be described mainly using FIGS. 6 and 7.

Figure 6:
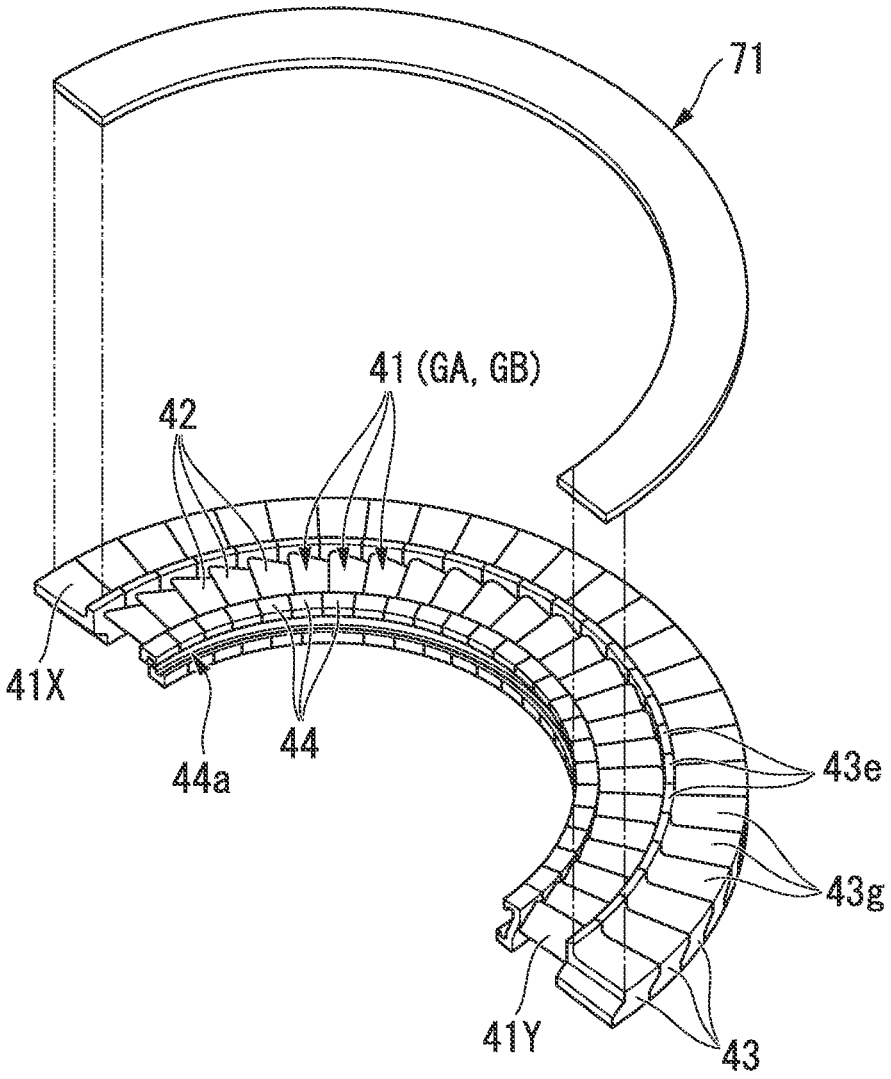
FIG. 6 is a first exploded configuration perspective view of the turbine vane unit related to the first embodiment of the present invention.

First, as shown in FIG. 6, for each turbine vane member group G (GA or GB), the turbine vane members 41 are coupled one by one to the plate member 71 (a coupling process). For example, the turbine vane members 41 of the turbine vane member group GA are bolted onto the plate member 71. In addition, the fixing may also be performed by another method.

At this time, it is preferable to perforate a bolt hole in each turbine vane member 41 in advance and also perforate a through-hole in the plate member 71 so as to correspond to each bolt hole in a state where the turbine vane members 41 are connected in a semi-annular shape. This way, the turbine vane member 41 and the plate member 71 can be easily positioned by overlapping the bolt hole and the through-hole.

This way, the turbine vane members 41 coupled to the plate member 71 are integrated in a state of being arranged in a semi-annular shape. At this time, the shroud gap M is formed between the two turbine vane members 41 adjacent to each other in the circumferential direction (refer to FIG. 4).

Similarly, for example, also with respect to the turbine vane member group GB, the turbine vane members 41 are bolted one by one onto the plate member 71 (a coupling process).

Figure 7:
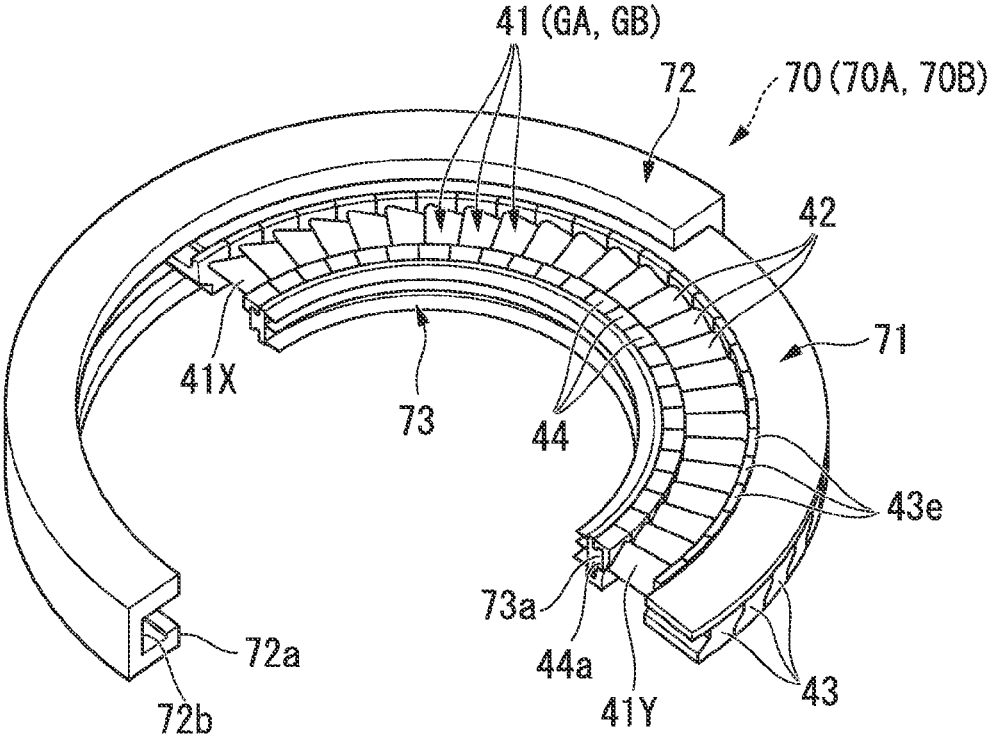
FIG. 7 is a second exploded configuration perspective view of the turbine vane unit related to the first embodiment of the present invention.

Then, as shown in FIG. 7, the protruded portion 73*a* of the inner ring member 73 is fitted into the fitting grooves 44*a* of the inner shrouds 44 of the turbine vane members 41.

For example, with respect to each of the turbine vane member group GA and the turbine vane member group GB, the inner ring member 73 is fitted.

Next, as shown in FIG. 7, one end in the circumferential direction of an assembly in which the turbine vane members 41 are assembled to the plate member 71 is inserted into the other end in the circumferential direction of the semi-annular groove portion 72*b* of the outer ring member 72, whereby the outer shroud 43 is fitted into the semi-annular groove portion 72*b* (an intermediate unit manufacturing process). Then, as shown in FIG. 5, one end in the circumferential direction of the above-described assembly is inserted until it reaches one end in the circumferential direction of the outer ring member 72, whereby assembly of the turbine vane unit (the intermediate unit) 70 is completed. For example, with respect to each of the turbine vane member group GA and the turbine vane member group GB, the outer ring member 72 is fitted, whereby assembly of each of the turbine vane units 70A and 70B is completed. In addition, the outer ring member 72 may also be fitted before the inner ring member 73 is fitted to the turbine vane member group G Further, the above-described assembly may also be inserted in the radial direction into the semi-annular groove portion 72*b* of the outer ring member 72.

Then, as shown in FIG. 2, both end portions in the circumferential direction of the turbine vane units 70A and 70B (the outer ring members 72 and the inner ring members 73) are joined to each other.

For example, after the turbine vane unit 70A is fixed to the inner wall surface of the casing 10, the shaft body 30 is disposed, and after the turbine vane unit 70B is disposed across the shaft body 30, both end portions in the circumferential direction of the turbine vane units 70A and 70B (the outer ring members 72 and the inner ring members 73) are joined to each other. At this time, assembly is performed such that the outer shroud 43 (the turbine vane member 41X) exposed by half a pitch by the plate member 71 of one of the turbine vane units 70A and 70B is covered by a portion (the turbine vane member 41Y side) extending in the circumferential direction by half a pitch of the plate member 71 of the other side. Thereafter, the turbine vane unit 70B is fixed to the inner wall surface of the casing 10.

In this way, the turbine vane units 70A and 70B of each stage are joined to each other, whereby the turbine vane row 40 is constituted, and finally, assembly of the steam turbine 1 is completed.

In the steam turbine 1 assembled in this way, as shown in FIGS. 2 and 4, the shroud gaps M are covered and sealed by the plate member 71. More specifically, since the recess portion 43*g* of the outer shroud 43 in each turbine vane member 41 is covered by the plate member 71, most of a portion in the semi-annular groove portion 72*b* of the shroud gap M and a portion exposed to the outside from the semi-annular groove portion 72*b* is sealed by the plate member 71.

Therefore, the steam S heading for the shroud gap M, of the steam S flowing in the axial direction toward the turbine vane member 41, collides with the plate member 71 and then flows to the turbine vane main body 42 side, thereby joining the main flow of the steam S. Then, the steam S changes the direction of flow due to the turbine vane main body 42 and flows in the turbine blade row 50 on the downstream side.

Further, since the plate member 71 seals most of a portion exposed to the radially inward side, of the shroud gap M, most of a portion exposed to the main flow of the steam S is sealed. In this way, the steam S flowing into the shroud gap M is significantly reduced.

In addition, there is almost no steam S flowing out from the shroud gap M to the main flow side in the turbine vane row 40, and thus the steam S flows out from the turbine vane row 40 at a designed angle without causing disturbance of the main flow in the turbine vane row 40, and then flows in the turbine blade row 50.

As described above, according to the steam turbine 1 related to this embodiment, since the plurality of turbine vane members 41 is connected and also the outer shrouds 43 of the turbine vane members 41 are covered from one side in the axial direction, thereby sealing the shroud gaps M, even if the steam S heads for the shroud gaps M from one side in the axial direction, the steam S collides with the plate member 71, and thus inflow of the steam S into the shroud gaps M is blocked. In this manner, the steam S collided with the plate member 71 flows to the turbine vane main body 42 side and then joins the main flow of the steam S. Therefore, since the flow rate of the main flow can be increased, the turbine efficiency can be improved.

Further, since the plate member 71 blocks inflow of the steam S to the shroud gap M, there is almost no steam S flowing out from the shroud gap M to the main flow side in the turbine vane row 40. In this way, since it becomes difficult for disturbance of the main flow to occur in the turbine vane row 40, and thus the main flow flowing out from the turbine vane row 40 becomes a designed flow, the turbine efficiency can be improved.

Further, since the plate member 71 is provided over the circumference of the entirety of the plurality of outer shrouds 43, all the shroud gaps M formed in a plurality over the circumferential direction can be sealed.

Further, since the plate member 71 seals most of a portion exposed to the radially inward side of the shroud gap M, a portion that is exposed to the main flow of the steam S is sealed. In this way, the steam S flowing into the shroud gap M can be effectively reduced.

Further, according to a method for manufacturing a turbine in this embodiment, it is possible to easily obtain the configuration of the steam turbine 1 in which the turbine efficiency can be improved.

Further, according to the method for manufacturing a turbine in this embodiment, for each turbine vane member group G (GA or GB), the plurality of turbine vane members 41 integrated is fitted together into the semi-annular groove portion 72*b* of the outer ring member 72. That is, in a method for manufacturing a turbine in the related art, when incorporating the turbine vane members 41 into the outer ring member 72, since the turbine vane members 41 have to be individually fitted into the semi-annular groove portion 72*b* of the outer ring member 72, labor is required for assembly. However, according to the above-described method, since the labor of fitting the plurality of turbine vane members 41 one by one into the semi-annular groove portion 72*b* of the outer ring member 72 is omitted, assembly can be easily performed.

Further, since the plurality of turbine vane units 70A and 70B is disposed in the entire circumference, thereby constituting the turbine vane row 40, assembly can be more easily performed.

In addition, in the configuration described above, the station blade row 40 is constituted by disposing the turbine vane units 70A and 70B in each stage. However, a configuration is also possible in which the turbine vane members 41 in each stage are grouped into three or more groups and the turbine vane units are constituted to correspond to the number of groups.

Further, if one turbine vane unit 70A is provided, then the plate member 71 of the remaining portion (a portion equivalent to the turbine vane unit 70B) may be omitted.

Further, in the configuration described above, the plate member 71 is provided at the circumference of the entirety of the outer shrouds 43 arranged annularly. However, even if the plate member 71 is provided at just one portion in the circumferential direction, it is possible to prevent a leakage flow of the steam S in the portion.

Further, in the configuration described above, the inner peripheral edge 43*e* is exposed without being covered by the plate member 71. However, the entirety of the shroud gap M may be sealed by covering the inner peripheral edge 43*e*. According to this configuration, the steam S flowing into the shroud gap M can be further reduced.

Further, in the configuration described above, each of the turbine vane member groups GA and GB is constituted by a half of the turbine vane members 41 belonging to each turbine vane row 40. However, the number is arbitrary and it is possible to appropriately adjust the number. In this case, it is preferable to appropriately adjust the dimension of the outer ring member 72 in the circumferential direction depending on the number of turbine vane members 41.

Further, in the configuration described above, the outer ring member 72 and the outer shroud 43 are fitted to each other by forming the semi-annular groove portion 72*b* in the outer ring member 72. However, the outer ring member 72 and the outer shroud 43 may be fitted to each other by forming a semi-annular groove portion in the outer shroud 43.

Second Embodiment

Figure 8:
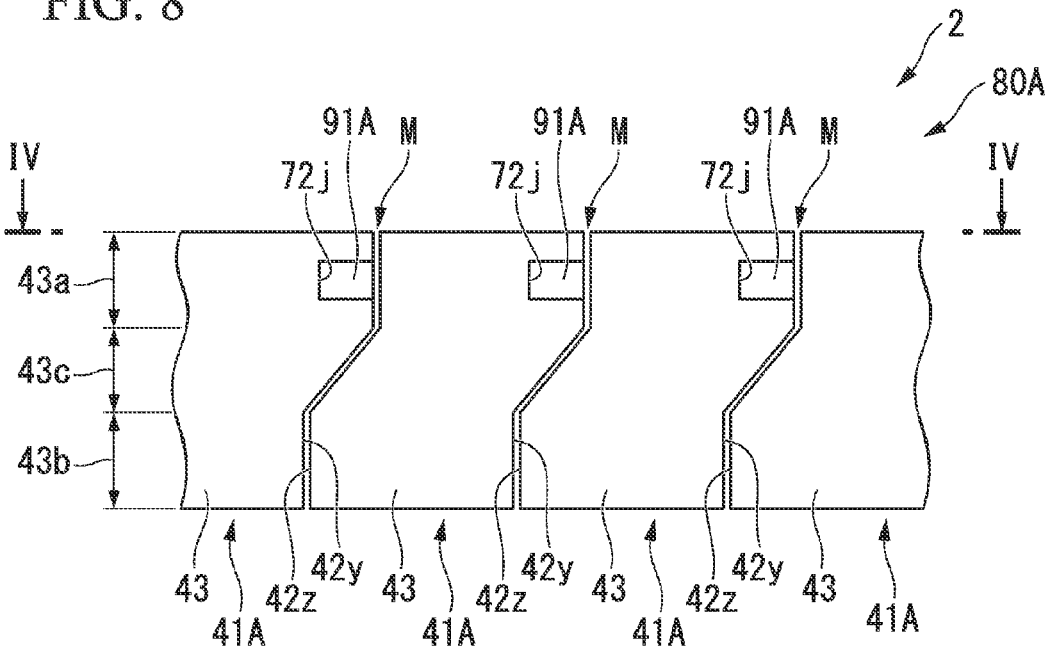
FIG. 8 is a blade row diagram of a turbine vane unit of a steam turbine related to a second embodiment of the present invention.
Figure 9:
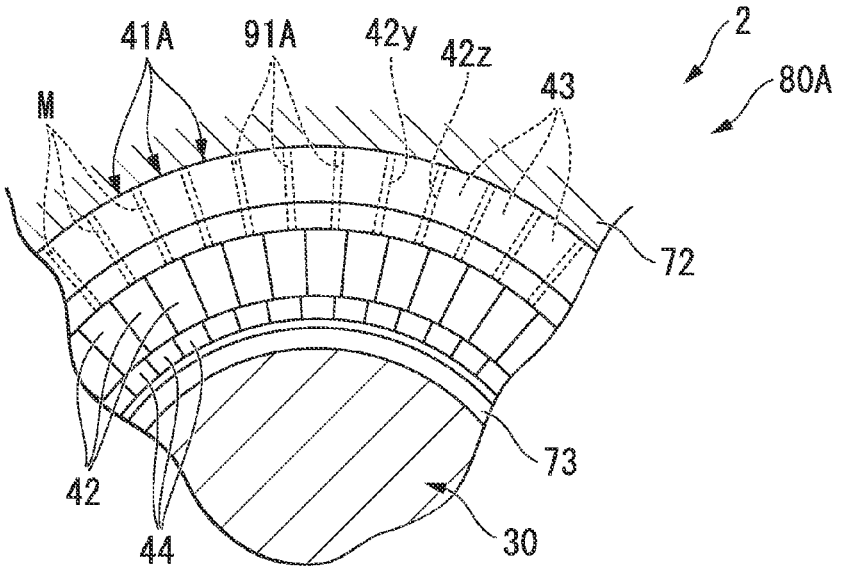
FIG. 9 is a view in the direction of an arrow of line IV-IV in FIG. 8.
Figure 10:
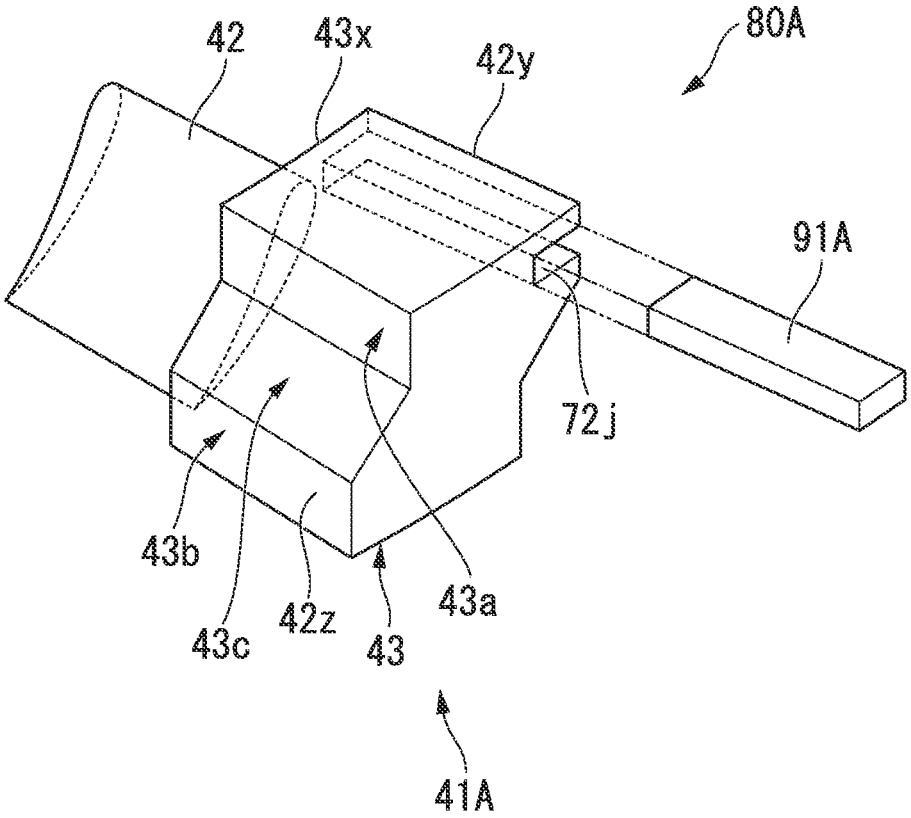
FIG. 10 is a cross-sectional view of a main section of the turbine vane unit related to the second embodiment of the present invention.

FIG. 8 is a blade row diagram of a turbine vane unit 80A of a steam turbine 2 related to a second embodiment of the present invention, FIG. 9 is a view in the direction of an arrow of line IV-IV in FIG. 8, and FIG. 10 is a schematic perspective view of a turbine vane member 41A of the turbine vane unit 80A. In addition, in FIGS. 8 to 10, the same constituent elements as those in FIGS. 1 to 7 are denoted by the same signs and description thereof is omitted.

As shown in FIG. 8, the turbine vane unit 80A is different from the turbine vane unit 70 in the first embodiment in that compared to the turbine vane unit 70 in the first embodiment, the plate member 71 is omitted and the turbine vane unit 80A includes a turbine vane member 41A instead of the turbine vane member 41.

The turbine vane member 41A has almost the same configuration as the turbine vane member 41. However, a rectangular groove 73*j* is formed toward the radial direction (the direction of the blade axis) in the front portion 43*a* side of one end face 42*y* of the outer shroud 43, and a thermal expansion piece 91A is fitted into the rectangular groove 73*j*.

The thermal expansion piece 91A is a rod-like member in which the cross-section intersecting a longitudinal direction has a rectangular shape, as shown in FIGS. 8 to 10, and is formed of a material having higher linear thermal expansion coefficient than the turbine vane member 41A.

According to this embodiment, if the temperature of the thermal expansion piece 91A rises due to the steam S having a high temperature, the thermal expansion piece 91A thermally expands in the circumferential direction (a tangential direction), thereby coming into close contact with the other end face 42*z* of the adjacent outer shroud 43. Since the shroud gap M is sealed in this way, and thus the leakage flow of the steam S is reduced, the turbine efficiency can be improved.

Third Embodiment

Figure 11:
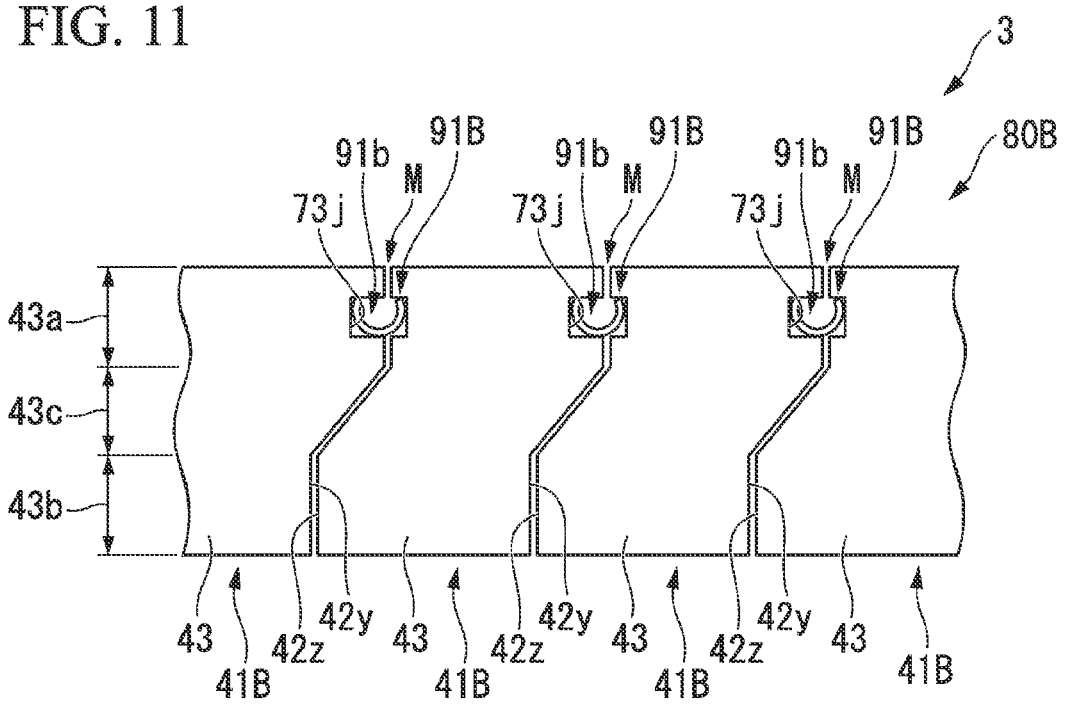
FIG. 11 is a blade row diagram of a turbine vane unit of a steam turbine related to a third embodiment of the present invention.

FIG. 11 is a blade row diagram of a turbine vane unit 80B of a steam turbine 3 related to a third embodiment of the present invention. In addition, in FIG. 11 (and FIG. 12), the same constituent elements as those in FIGS. 1 to 10 are denoted by the same signs and description thereof is omitted.

As shown in FIG. 11, the turbine vane unit 80B is different from the turbine vane unit 80A in the second embodiment in that compared to the turbine vane unit 80A in the second embodiment, the turbine vane unit 80B includes a turbine vane member 41B having an elastic piece 91B, instead of the turbine vane member 41A having the thermal expansion piece 91A.

Figure 12:
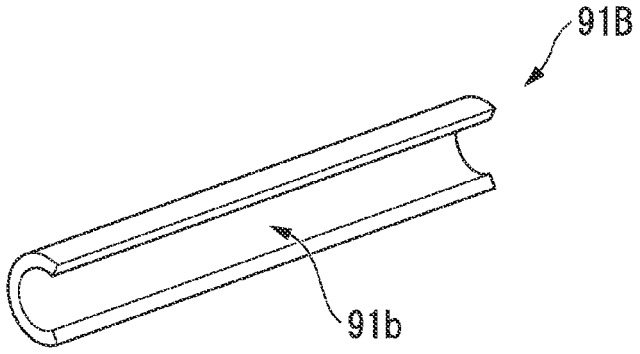
FIG. 12 is a schematic configuration perspective view of an elastic piece related to the third embodiment of the present invention.

FIG. 12 is a schematic configuration perspective view of the elastic piece 91B.

As shown in FIG. 12, the elastic piece 91B is a rod-like member in which the cross-section in a longitudinal direction has a C-shape, and is formed of an elastic material (for example, spring steel or the like). The elastic piece 91B is inserted into the rectangular groove 73*j* in a state where an open portion 91*b* in the radial direction is directed to one side (the front side) in the axial direction, as shown in FIG. 11, According to this embodiment, the steam S flowed in the shroud gap M flows in the open portion 91*b* of the elastic piece 91B, whereby the elastic piece 91B spreads to the outer periphery side, thereby coming into close contact with the other end face 42*z* of the circumferentially adjacent outer shroud 43. Since the shroud gap M is sealed in this way, and thus the leakage flow of the steam S is reduced, the turbine efficiency can be improved.

Figure 13:
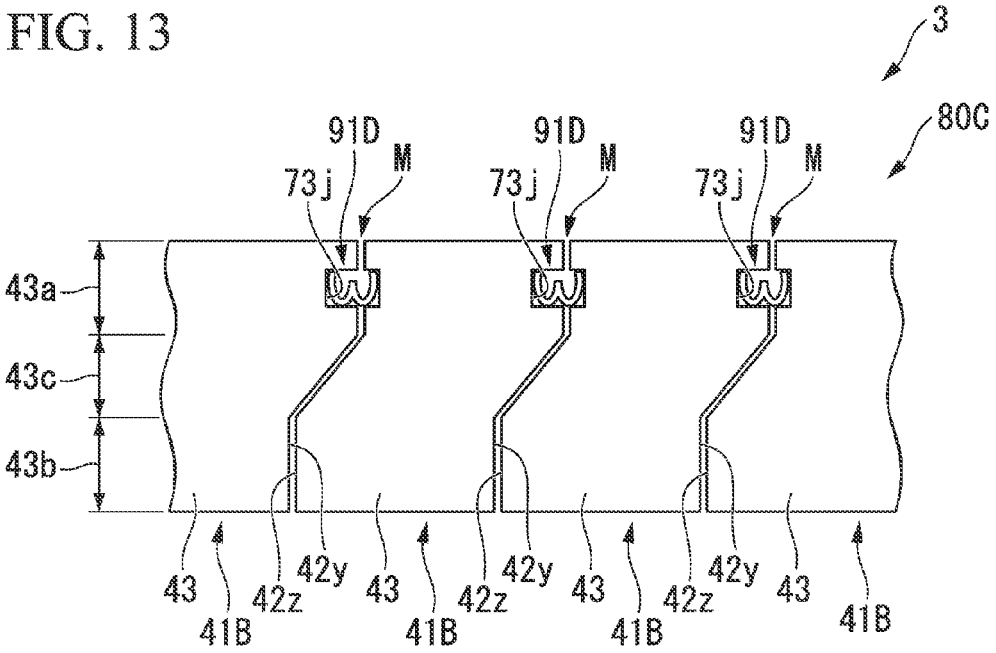
FIG. 13 is a blade row diagram of a modified example of the steam turbine related to the third embodiment of the present invention.

In addition, in the configuration described above, a configuration is adopted in which the elastic piece 91C in which the cross-section in a longitudinal direction has a C-shape is inserted into the rectangular groove 73*j*. However, as shown in FIG. 13, a configuration is also possible in which an elastic piece 91D in which the cross-section in a longitudinal direction has a W-shape is inserted into the rectangular groove 73*j*.

Fourth Embodiment

Figure 14:
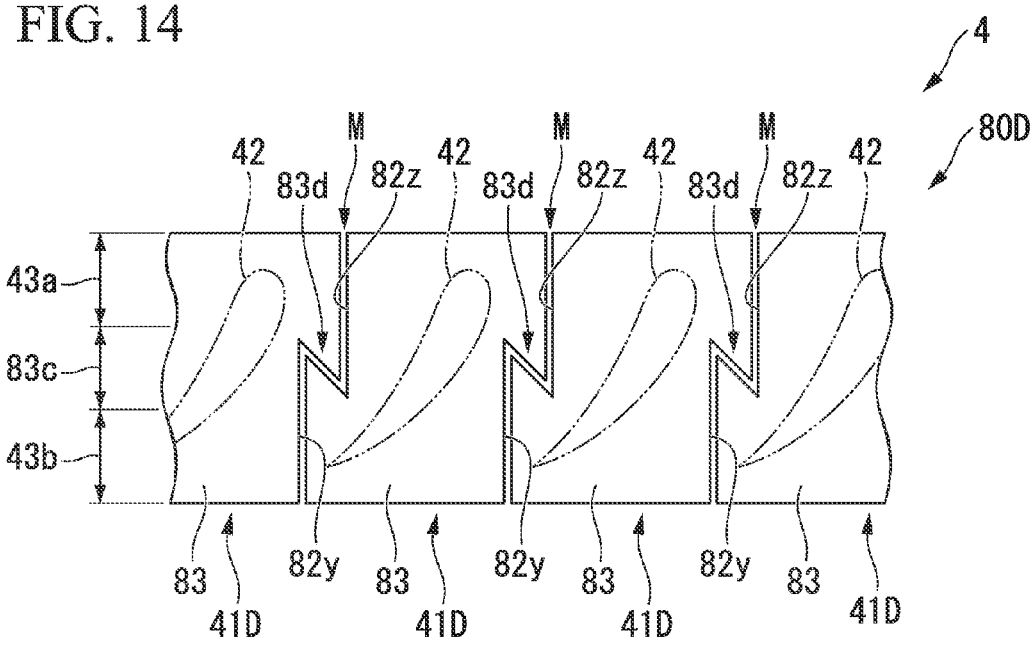
FIG. 14 is a blade row diagram of a turbine vane unit of a steam turbine related to a fourth embodiment of the present invention.

FIG. 14 is a blade row diagram of a turbine vane unit 80D of a steam turbine 4 related to a fourth embodiment of the present invention. In addition, in FIG. 14, the same constituent elements as those in FIGS. 1 to 13 are denoted by the same signs and description thereof is omitted.

As shown in FIG. 14, the turbine vane unit 80D is different from the turbine vane unit 70 in the first embodiment in that compared to the turbine vane unit 70 in the first embodiment, the plate member 71 is omitted and the turbine vane unit 80D includes a turbine vane member 41D having an outer shroud 83.

The outer shroud 83 is different from the outer shroud 43 in the first embodiment in that each of one end face 42*y* and the other end face 42*z* of the outer shroud 43 in the first embodiment is formed in a step shape when viewed in the cross-section in the radial direction, whereas each of one end face 82*y* and the other end face 82*z* is formed in an N-shape when viewed in the cross-section in the radial direction.

That is, in each of one end face 42*y* and the other end face 42*z* of the outer shroud 43 in the first embodiment, the front portion 43*a* and the rear portion 43*b* are connected by the intermediate portion 43*c* inclined gently from the front side to the rear side, whereas in each of one end face 82*y* and the other end face 82*z* in this embodiment, an intermediate portion 83*c* is formed so as to be folded back from the rear side to the front side and connects the front portion 43*a* and the rear portion 43*b*, as shown in FIG. 14. Therefore, in the shroud gap M, a folding-back portion 83*d* defined by closely folding back the intermediate portion 83*c* is formed.

According to this embodiment, since the folding-back portion 83*d* is formed in the shroud gap M, the folding-back portion 83*d* acts as large flow resistance on the steam S flowing into the shroud gap M. In this way, the leakage flow of the steam S is reduced, and thus the turbine efficiency can be improved.

Fifth Embodiment

Figure 15:
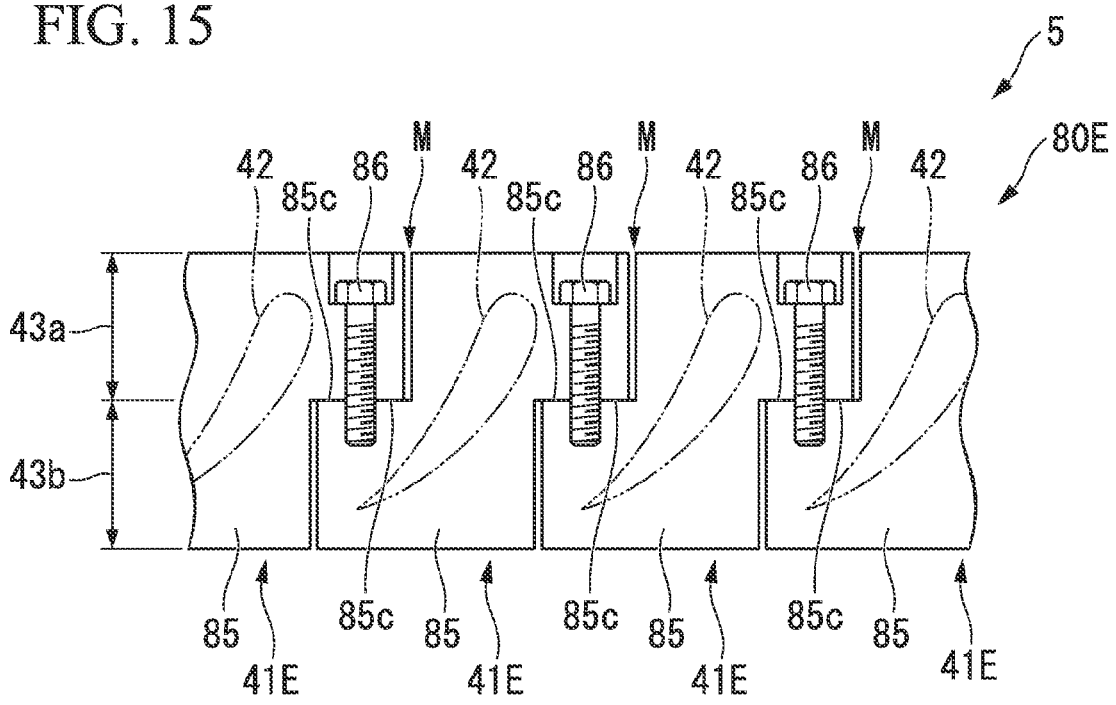
FIG. 15 is a blade row diagram of a turbine vane unit of a steam turbine related to a fifth embodiment of the present invention.

FIG. 15 is a blade row diagram of a turbine vane unit 80E of a steam turbine 5 related to a fifth embodiment of the present invention. In addition, in FIG. 15, the same constituent elements as those in FIGS. 1 to 14 are denoted by the same signs and description thereof is omitted.

As shown in FIG. 15, the turbine vane unit 80E is different from the turbine vane unit 70 in the first embodiment in that compared to the turbine vane unit 70 in the first embodiment, the plate member 71 is omitted and the turbine vane unit 80E includes a turbine vane member 41E having an outer shroud 85.

In each of one end face 42*y* and the other end face 42*z* in the first embodiment, the intermediate portion 43*c* is gently inclined and connects the front portion 43*a* and the rear portion 43*b*, whereas in each of one end face 85*y* and the other end face 85*z* of the outer shroud 85, as shown in FIG. 15, an orthogonal plane 85*c* orthogonal to the axial direction connects the front portion 43*a* and the rear portion 43*b*.

Further, in two outer shrouds 85 adjacent to each other in the circumferential direction, the front portion 43*a* on one side and the rear portion 43*b* on the other side are connected by a bolt 86 extending in the axial direction, and thus the orthogonal plane 85*c* of one end face 85*y* on one side and the orthogonal plane 85*c* of the other end face 85*c* on the other side are axially pressed against each other, thereby coming into close contact with each other.

According to this configuration, the orthogonal plane 85*c* of one end face 85*y* of one side of the two outer shrouds 85 adjacent to each other in the circumferential direction and the other end face 85*c* on the other side come into close contact with each other, and thus the shroud gap M is sealed. In this way, the leakage flow of the steam S is reduced, and thus the turbine efficiency can be improved.

Sixth Embodiment

Figure 16:
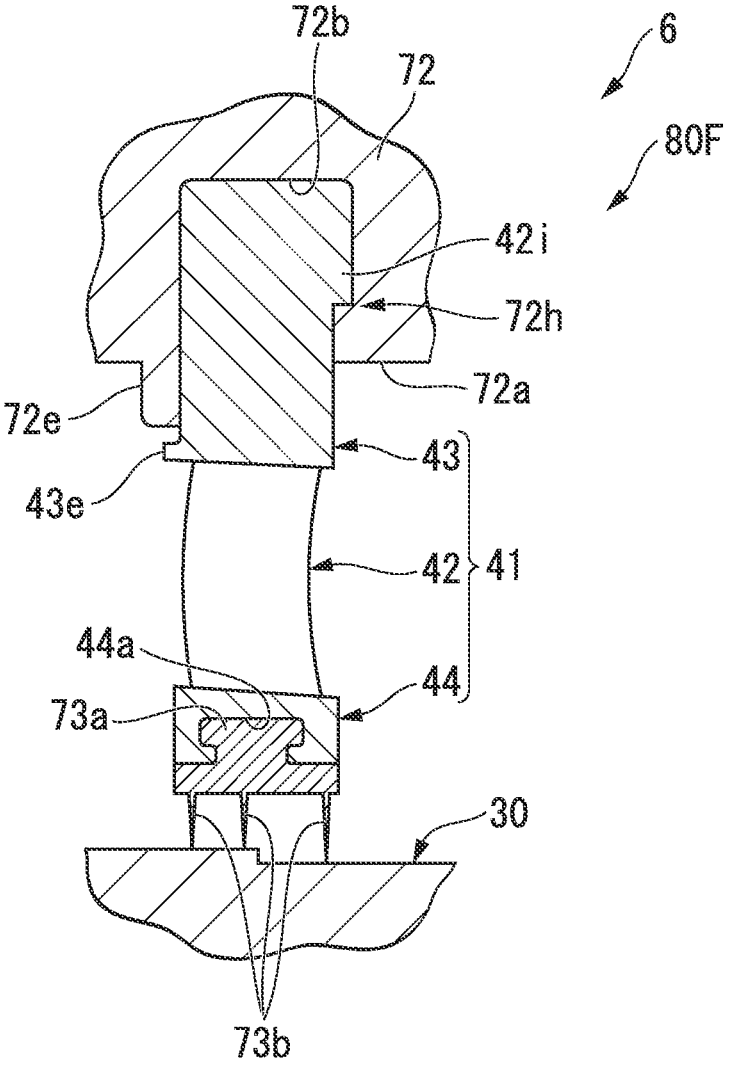
FIG. 16 is an enlarged cross-sectional view of a main section of a turbine vane unit of a steam turbine related to a sixth embodiment of the present invention.

FIG. 16 is an enlarged cross-sectional view of a main section of a turbine vane unit 80F of a steam turbine 6 related to a sixth embodiment of the present invention. In addition, in FIG. 16, the same constituent elements as those in FIGS. 1 to 15 are denoted by the same signs and description thereof is omitted.

As shown in FIG. 16, the turbine vane unit 80F is different from the turbine vane unit 70 in the first embodiment in that compared to the turbine vane unit 70 in the first embodiment, the plate member 71 is omitted and the turbine vane unit 80F includes an extension portion 72*e* extending from an edge portion on one side in the axial direction of the semi-annular groove portion 72*b* of the outer ring member 72 to the radially inward side.

The extension portion 72*e* covers and seals most of the shroud gap M exposed from the semi-annular groove portion 72*b* to the outside.

According to this configuration, since the extension portion 72*e* seals the shroud gap M exposed from the semi-annular groove portion 72*b* to the outside, the leakage flow of the steam S is reduced, and thus the turbine efficiency can be improved.

In addition, operating procedure or the shapes, the combination, or the like of the respective constituent members shown in the embodiments described above is an example, and various changes can be made based on design requirements or the like within a scope that does not depart from the gist of the present invention.

For example, in each embodiment described above, the embodiment in which the present invention is applied to the steam turbine has been described. However, the present invention may also be applied to a gas turbine.

INDUSTRIAL APPLICABILITY

According to the present invention, the turbine efficiency can be improved. Further, according to the method for manufacturing a turbine related to the present invention, assemblability of a turbine can be improved. The present invention can be used in not only a steam turbine, but also a gas turbine.

REFERENCE SIGNS LIST

1, 2, 3, 4, 5, 6: steam turbine
10: casing
11: outer ring
12: inner ring
30: shaft body
40: turbine vane row
41 (41X, 41Y): turbine vane member
42: turbine vane main body
43: outer shroud (shroud)
50: turbine blade row
51: turbine blade member
70 (70A, 70B): turbine vane unit (intermediate unit)
71: plate member
72: outer ring member
72*a*: inner peripheral portion
G (GA, GB): turbine vane member group
M: shroud gap

The invention claimed is:

1. A turbine comprising:

a shaft body supported rotatably;

a plurality of turbine blade members that is provided on an outer periphery of the shaft body and constitutes a turbine blade row in a circumferential direction of the shaft body;

a casing covering the shaft body and the turbine blade row;

an outer ring that is provided on an inner periphery of the casing and includes an inner peripheral portion in which a cross-section having an uneven shape is continuous in a circumferential direction;

a plurality of turbine vane members that each has a shroud fitted into the inner peripheral portion of the outer ring and a turbine vane main body extending from the shroud to a radially inward side and that is provided in the circumferential direction and constitutes a turbine vane row in which the shrouds adjacent to each other are aligned in the circumferential direction; and a plate member that connects at least some of the plurality of turbine vane members and covers one side of the shrouds in an axial direction, thereby sealing a shroud gap formed between the shrouds adjacent to each other in the circumferential direction, wherein the inner peripheral portion of the outer ring is formed as a groove extending in the circumferential direction, and the plate member seals at least a portion of each of the shrouds that protrude from the inner peripheral portion of the outer ring to the radially inward side of the shroud gap.

2. The turbine according to claim 1, wherein a plurality of plate members is provided continuously in the circumferential direction.

3. The turbine according to claim 1, wherein the plate member is provided over the circumference of the entirety of the plurality of shrouds.

4. The turbine according to claim 1, wherein the plate member seals the entire shroud gap.

5. The turbine according to claim 2, wherein the plate member is provided over the circumference of the entirety of the plurality of shrouds.

6. The turbine according to claim 2, wherein the plate member seals the entire shroud gap.

7. A method for manufacturing a turbine that includes a shaft body supported rotatably;

a plurality of turbine blade members that is provided on an outer periphery of the shaft body and constitutes a turbine blade row in a circumferential direction of the shaft body;

a casing covering the shaft body and the turbine blade row;

an outer ring that is provided on an inner periphery of the casing and includes an inner peripheral portion in which a cross-section having an uneven shape is continuous in a circumferential direction; and a plurality of turbine vane members that each has a shroud fitted into the inner peripheral portion of the outer ring and a turbine vane main body extending from the shroud to a radially inward side and that is provided in the circumferential direction and constitutes a turbine vane row in which the shrouds adjacent to each other are aligned in the circumferential direction, the method comprising:

a preparing process of preparing a plurality of turbine vane members, a plate member, and a plurality of outer ring members constituting the outer ring in which the inner peripheral portion of the outer ring is formed as a groove extending in the circumferential direction, in advance;

a coupling process of coupling and integrating the shrouds of the plurality of turbine vane members belonging to one of a plurality of turbine vane member groups made by grouping the plurality of turbine vane members, by the plate member;

an intermediate unit manufacturing process of manufacturing an intermediate unit by fitting the shrouds of the plurality of turbine vane members coupled and integrated by the plate member into an inner peripheral portion of the outer ring member so that the plate member seals at least a portion of each of the shrouds that protrude from the inner peripheral portion of the outer ring to the radially inward side of a shroud gap formed between the shrouds adjacent to each other in the circumferential direction; and a connection process of connecting the intermediate unit to a unit in which the plurality of turbine vane members belonging to the other turbine vane member group is fitted into the outer ring member.

8. The method for manufacturing a turbine according to claim 7, wherein the unit is constituted as the intermediate unit.

9. A turbine comprising:

a shaft body supported rotatably;

a plurality of turbine blade members that is provided on an outer periphery of the shaft body and constitutes a turbine blade row in a circumferential direction of the shaft body;

a casing covering the shaft body and the turbine blade row;

an outer ring that is provided on an inner periphery of the casing and includes an inner peripheral portion in which a cross-section having an uneven shape is continuous in a circumferential direction;

a plurality of turbine vane members that each has a shroud fitted into the inner peripheral portion of the outer ring and a turbine vane main body extending from the shroud to a radially inward side and that is provided in the circumferential direction and constitutes a turbine vane row in which the shrouds adjacent to each other are aligned in the circumferential direction; and a plate member that connects at least some of the plurality of turbine vane members and covers one side of the shrouds in an axial direction, thereby sealing a shroud gap formed between the shrouds adjacent to each other in the circumferential direction, wherein the inner peripheral portion of the inner ring is formed as a groove extending in the circumferential direction, and the plate member seals a portion of the shroud gap inside the outer ring and at least a portion of each of the shrouds that protrude from the inner peripheral portion of the outer ring to the radially inward side of the shroud gap.

10. The turbine according to claim 9, wherein the plate member is provided over the circumference of the entirety of the plurality of shrouds.

11. The turbine according to claim 9, wherein the plate member seals the entire shroud gap.

* * * * *